US007156885B2

(12) United States Patent
Kennedy et al.

(10) Patent No.: US 7,156,885 B2
(45) Date of Patent: Jan. 2, 2007

(54) HAIR COLORING DEVICE

(75) Inventors: Melvin R. Kennedy, Lantana, FL (US); Jose Longoria, Miami, FL (US); Robert G. Robbins, Boca Raton, FL (US); Richard Kaiser, Allentown, PA (US)

(73) Assignees: Kennedy/Matsumoto Design LLC, Lantana, FL (US); Longoria Design LLC, Miami, FL (US); Spectrum Associates LLC, Boca Raton, FL (US)

( * ) Notice: Subject to any disclaimer, the term of this patent is extended or adjusted under 35 U.S.C. 154(b) by 0 days.

(21) Appl. No.: 11/255,812

(22) Filed: Oct. 21, 2005

(65) Prior Publication Data

US 2006/0207036 A1 Sep. 21, 2006

Related U.S. Application Data

(60) Provisional application No. 60/663,322, filed on Mar. 18, 2005.

(51) Int. Cl.
*A61K 7/13* (2006.01)

(52) U.S. Cl. ..... 8/405; 8/435; 8/525; 8/526; 8/538; 8/581; 132/208; 132/213.1; 132/221

(58) Field of Classification Search ..... 8/405, 8/435, 525, 526, 538, 581; 132/208, 213.1, 132/221
See application file for complete search history.

(56) References Cited

U.S. PATENT DOCUMENTS

| | | | | |
|---|---|---|---|---|
| 6,053,177 | A | 4/2000 | Sofer | |
| 6,568,404 | B1 | 5/2003 | Mitchem | |
| 6,675,812 | B1 | 1/2004 | Wiley | |
| 6,848,452 | B1 * | 2/2005 | Kennedy et al. | 132/208 |
| 2004/0159329 | A1 | 8/2004 | Kennedy et al. | |

* cited by examiner

*Primary Examiner*—Eisa Elhilo
(74) *Attorney, Agent, or Firm*—Akerman Senterfitt

(57) ABSTRACT

Devices configured to permit the application of color to hair from a solid or semi-solid hair coloring composition and methods relating to use of such devices are disclosed. The device includes a support, and a solid or semi-solid hair coloring composition fixedly disposed on the support. The solid or semi-solid hair coloring composition includes a soap gelling agent such that the hair coloring composition retains its shape, and can be provided as a block having a predefined shape. These devices are not attendant with dripping as has been associated with prior art hair color applicators.

26 Claims, 9 Drawing Sheets

FIG. 1
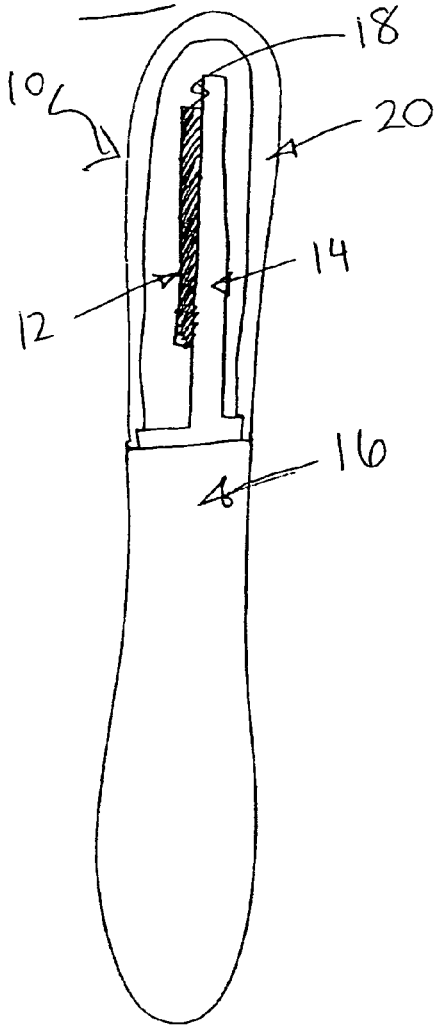
Fig. 2a
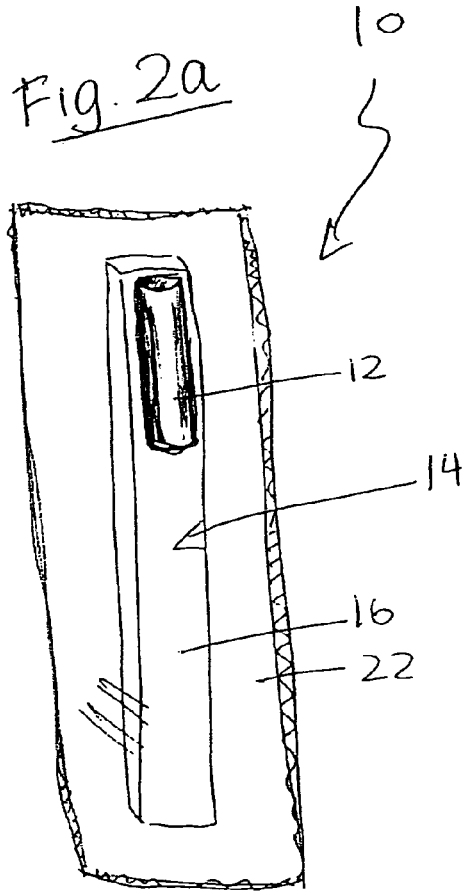
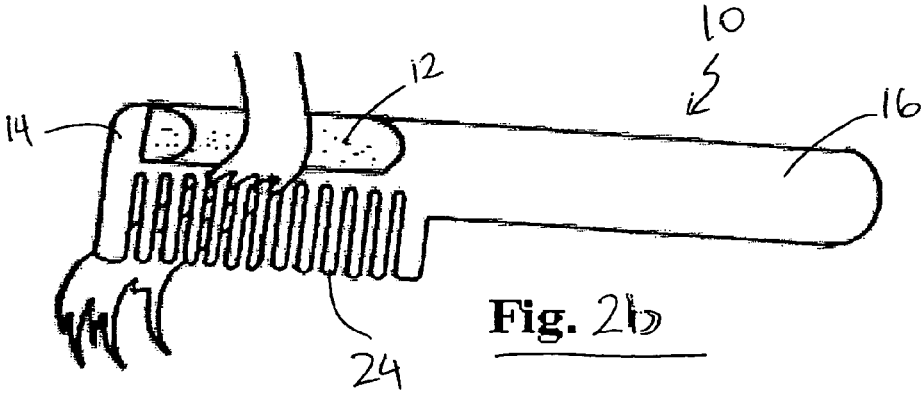
Fig. 2b

12a
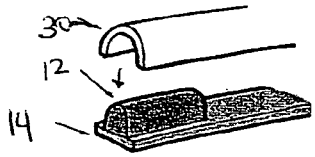
12b
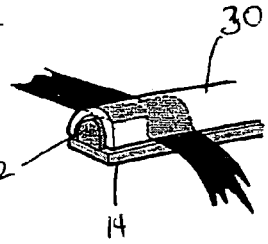
12c
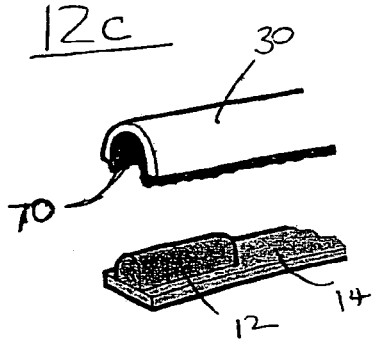
12d
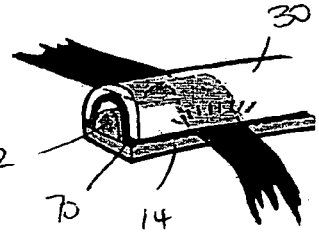
13a
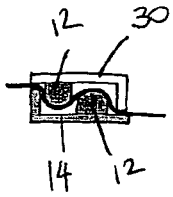
13b
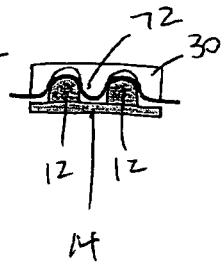
13c
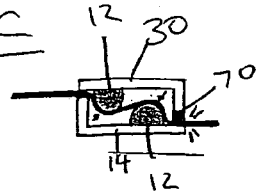
13d
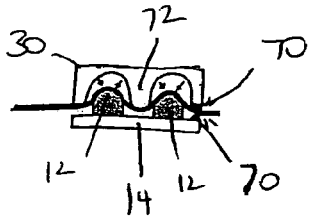

HAIR COLORING DEVICE

CROSS-REFERENCE TO RELATED APPLICATIONS

This application claims the benefit of U.S. Provisional Patent Application No. 60/663,322, filed Mar. 18, 2005, the entire contents of which are incorporated by reference herein.

FIELD OF THE INVENTION

This invention is directed generally to hair coloring devices, and more particularly to devices for applying solid and semi-solid hair coloring compositions to hair.

BACKGROUND

Hair coloring compositions are used in many different ways to apply coloring to hair and eyelashes for example. Hair coloring is undertaken to change or cover the color of hair for many different reasons. For instance, hair is often dyed to cover hair that has turned gray, to lighten or change the shade of hair, or to highlight or lowlight hair. Bright colors may be used for a fun effect, especially with temporary coloring compositions. The hair coloring procedures used to generate these results are often markedly different and use different coloring compositions. The hair coloring compositions may be permanent or semi-permanent dyes. Temporary dyes are also used that may be washed from the colored hair with conventional shampoo and water. Alternatively, the coloring composition may be materials which coat the hair with a colored substance to impart a temporary color to the hair.

Salon dye application typically involves mixing and then applying liquid dye to the hair by a technician or stylist. The dye may be applied to the hair in a liquid form, or may be mixed to form a gel or paste. This process is complicated and time consuming, and many devices and systems exist to enable a person to color their own hair, or to enable professional colorists to more easily apply dye or color to the hair in a salon.

A system for applying color to hair is shown in U.S. Pat. No. 6,053,177, which depicts a cartridge coupled to a plurality of hollow dispensing times. The times resemble the bristles of a common hair brush. The cartridge includes a piston that forces a liquid hair dye through the tines to contact hair while the cartridge is passed through hair as though brushing hair using a conventional hair brush. This is exemplary of many hand held devices that use liquid colorants.

U.S. Pat. No. 6,675,812 describes a hand-held dispenser having a comb or brush and an optional sponge for application of liquids such as dyes to the hair. U.S. Pat. No. 6,568,404 depicts an applicator for depositing a hair treatment fluid to a discreet strand of hair. The applicator is in the form of a longitudinal container having a hook-shaped end, which may contain a wick. A hair strand is placed in the hook-shaped end, and the applicator is drawn along the length of the strand to deposit the treatment fluid onto the strand. This too is exemplary of another construction of devices for applying liquid colorants.

U.S. patent application publication No. 2004-0159329 relates to a hair coloring apparatus which uses a revolving brush to transfer a solid or semi-solid hair colorant from a supply to hair. This device is complex and bulky, requiring batteries to drive a motor and numerous parts and so is not well suited for toting in a pocket or purse. It also can be difficult for a child or younger person to use.

A need exists for a hair color applicator capable of overcoming these and other disadvantages of the conventional systems, and in particular for a device that directly applies solid and semi-solid colorants to hair.

SUMMARY OF THE INVENTION

Devices configured to permit the application of color to hair from a solid or semi-solid hair coloring composition and methods relating to use of such devices are disclosed. These devices are not attendant with dripping as has been associated with prior art hair color applicators. The invention may be characterized by any combination of the following aspects and features.

In one aspect, the present invention concerns a hair coloring device including a support, and a solid or semi-solid hair coloring composition fixedly disposed on the support. The solid or semi-solid hair coloring composition comprising a soap gelling agent such that the hair coloring composition retains its shape.

The hair coloring composition can have a predefined shape, which can be disposed on the first surface of the support. The predefined shape can include a concave or a convex surface facing away from the first surface of the support.

A movable contact member can be included, which may be urgingly positionable by a user to place hair into contact with the hair coloring composition. A gripping material may be disposed on at least one of the movable contact member and the support member, the gripping material aiding retention of hair on the hair coloring material. A bias may also act upon the movable contact member, the bias urging the cover toward or away from the hair. The bias can be connected between the contact member and the support. In one arrangement, the contact member comprises a pivotally mounted clamp.

In one arrangement, a curved path for hair is defined against the hair coloring composition. The curved path may be defined between a movable contact member and the hair coloring composition. At least two hair coloring composition blocks may be provided in some arrangements, with the curved path defined such that the hair contacts said at least two hair coloring composition blocks. The curved path may be a serpentine path.

The hair coloring composition can be formed of water, a co-solvent, a soap gelling agent, a coloring agent, and a silicone polymer. In a preferred aspect, the soap gelling agent can be sodium stearate.

The hair coloring composition can be formed of from about 20 to about 35% by weight of water, from about 20 to about 35% by weight of co-solvent, from about 10 to about 30% by weight of soap gelling agent, and from about 15 to about 30% by weight of coloring agent. Optionally, the composition can further include from about 1 to about 5% by weight of a silicone polymer.

In some variations, the hair coloring composition can be formed of from about 27 to about 32% by weight of water, from about 26 to about 31% by weight of the co-solvent, and from about 12 to about 15% by weight of sodium stearate as the soap gelling agent. Preferably, the hair coloring composition can include from about 20 to about 25% by weight of the coloring agent.

The hair coloring composition can include at least one additional component selected from the group consisting of:

a dispersant, bactericide, fungicide, defoaming agent, and a combination thereof. The co-solvent may be propylene glycol.

The coloring agent may include titanium dioxide and a colorant. The coloring agent can include from about 5 to about 20% of titanium dioxide and about 5 to about 20% of the colorant. Preferably, the coloring agent includes from about 8 to about 15% of titanium dioxide and about 7 to about 15% of the colorant.

The coloring agent can include from about 15 to about 30% of a metallic coloring agent. Preferably, the coloring agent includes about 20% of the metallic coloring agent.

In another aspect, the present invention concerns a hair coloring device including a grip, a support extending from the grip and having a first surface, and a solid or semi-solid hair coloring composition fixedly disposed on the first surface of the support. A contact member is movably supported relative to the grip and urgingly positionable to an impermanent position in which the hair is pressed into contact with the hair coloring composition.

In another aspect, the present invention concerns a hair coloring device that includes a grip, a bearing surface, a solid or semi-solid hair coloring composition, and a contact member supporting the hair coloring composition, the contact member being movably supported relative to the grip and urgingly positionable by a user to an impermanent position in which the hair is pressed against the bearing surface into contact with the hair coloring composition.

These and other aspects and features of the invention will become apparent upon review of the enclosed drawings and detailed description below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

FIG. 1 is a perspective view of a hair coloring applicator constructed in accordance with the present invention.

FIG. 2*a* illustrates the basic construction of FIG. 1 and further illustrates a simple disposable hair coloring applicator.

FIG. 2*b* illustrates the basic construction of FIG. 2*a* in combination with a comb.

FIGS. 12*a* and 12*b* illustrate the basic construction of FIG. 1 and further illustrate the hair passing through a curved path to contact the hair composition.

FIGS. 12*c* and 12*d* illustrates the basic construction of FIGS. 12*a* and 12*b* and further illustrate material for gripping the hair.

FIGS. 13*a* and 13*b* illustrate a variation of the construction of FIGS. 12*a* and 12*b*.

FIGS. 13*c* and 13*d* illustrate a variation of the construction of FIGS. 13*a* and 13*b*.

DETAILED DESCRIPTION OF CERTAIN EMBODIMENTS OF THE INVENTION

Figure 3:
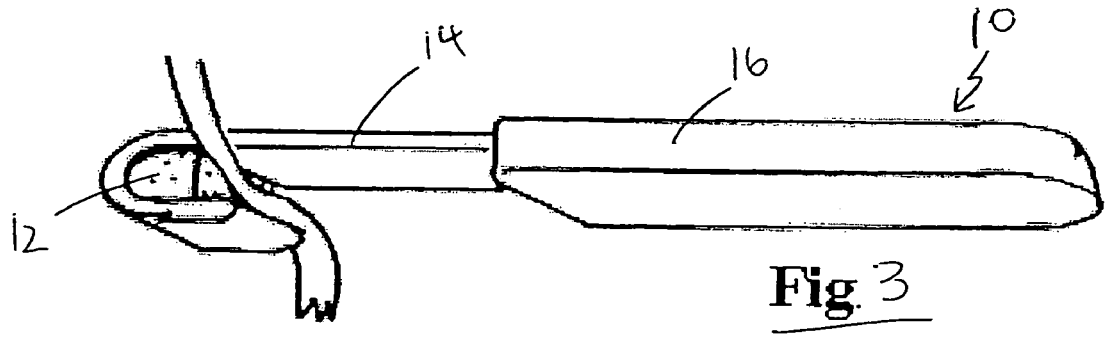
FIG. 3 illustrates the basic construction of FIG. 1 and further illustrates the hair coloring composition mounted on a hook-like support.

This invention is directed to a hair coloring device 10 which may have numerous configurations capable of applying a hair coloring composition 12 to the hair of a user and more particularly to hair on a user's head or to a wig. The hair coloring device is not limited to coloring only human hair, but may be used to color dolls hair, animal hair, filaments, and other items.

Referring to FIG. 1, an embodiment of a hair coloring device 10 for applying a hair coloring composition 12 includes a support 14 attached to a grip, which is illustrated as a handle 16. The device 10 is formed of any suitable material, and is preferably formed of plastic, but may also be cardboard or paper-based. The illustrated support 14 is elongated, and has a generally flat mounting surface 18 on which a block of the hair coloring composition 12 is supported. Alternatively, the mounting surface 18 can be curved, and the hair coloring composition 12 block can have a complementary curved surface abutting or facing the surface 18. For example, the mounting surface 18 and the hair coloring composition 12 can define a semi-cylindrical shape. In another arrangement, the mounting surface 18 is again generally flat, but the hair coloring composition has a contoured (e.g., a semi-cylindrical) shape.

The handle 16 is preferably sized such that the applicator is generally wand-shaped. The handle 16 can be formed of any material suitable for gripping and securing the support, such as a plastic material. The handle 16 preferably has an ergonomic shape that is easy for a user to hold.

The support 14 extends from the handle 16, and also can be a plastic material. The support 14 and handle 16 can be a single piece (as shown), or separate pieces attached to one another. Optionally, the support 14 is removable from the handle 16 for storage and/or replacement of the support and coloring composition. This can be by a snap-fit into an aperture provided in the handle 16, or by other conventional means suitable to secure the support and handle in the operative position as shown.

A removable cover 20 can protect the hair coloring composition 12 during transport and storage of the applicator 10. The cover can comprise a transparent material, or a transparent window to permit viewing the hair coloring composition 12 through the cover 20, if desired. As an alternative to a removable cover 20, a cover can be movably disposed about the support 14 to selectively uncover the hair coloring composition 12 prior to use. Preferably, the cover is shaped to protect the support and the hair coloring composition when in a closed position which is suitable for storage and transport of the hair coloring device, and which is movable so as to uncover the hair coloring composition for use in applying the hair coloring composition to the hair.

In accordance with a salient aspect of the invention, the hair coloring composition 12 is preferably a solid or semi-solid formulation. The hair coloring composition 12 is seated on the support 14 for direct contact of the hair coloring composition 12 with one or more strands of hair. To use the hair coloring applicator 10 of FIG. 1 (and any of the variations described hereafter) on a strand of hair, a user separates a strand of hair, opens the applicator by displacing (e.g., removing) the cover 20, and presses the hair coloring composition 12 against the hair. The user pulls the applicator 10 along the strand(s) of hair, depositing the hair coloring composition 12 onto the hair due to direct contact with the block. Of critical significance, since the block is a solid or semi-solid, there is no dripping such as is attendant with prior art devices.

Referring to FIG. 2*a*, in a variation of the construction of FIG. 1, the device 10 can be arranged as a simple disposable hair coloring applicator. The device 10 may be a one-piece disposable stick or wand. The hair coloring composition 12 is mounted onto the device 10 at one end thereof, with the other end of the device 10 forming the grip 16. The hair coloring composition may be provided on one side of the device 10, or may be provided on both sides of the device 10, or may completely cover the end of the device 10 in a similar manner to a lollipop. If the coloring composition 12 is provided on more than one side of the device 10, the user can conveniently turn the device 10 when the coloring composition 12 begins to wear away in use. The device 10 may be provided in a disposable packet 22, which may be formed of any suitable flexible material, such as a plastic material, and which may be torn open to access the device 10. The device 10 and packet 22 may be provided for low cost disposable use.

FIG. 2*b* illustrates a device as in FIG. 2*a* in combination with a comb 24. The comb can be drawn through hair and rotated so as to press hair against hair coloring composition 12 while the hair is being combed. This arrangement facilitates a one-handed hair coloring operation, as hair does not need to be held in contact with the coloring composition 12 while the device 10 is pulled along the hair strand.

Referring now to FIG. 3, a device 10 is illustrated having the basic construction of FIG. 1 and further including a hook-like support 14. The hair coloring composition is disposed within the hooked end of the support 14. One or more strands of hair may be captured by the hooked end of the support 14, for direct contact of the hair coloring composition 12 with one or more strands of hair. The hook-like support 14 enables the user to easily pull the device 10 along the strand(s) of hair, while retaining the hair in contact with the hair coloring composition 12.

Figure 4A:
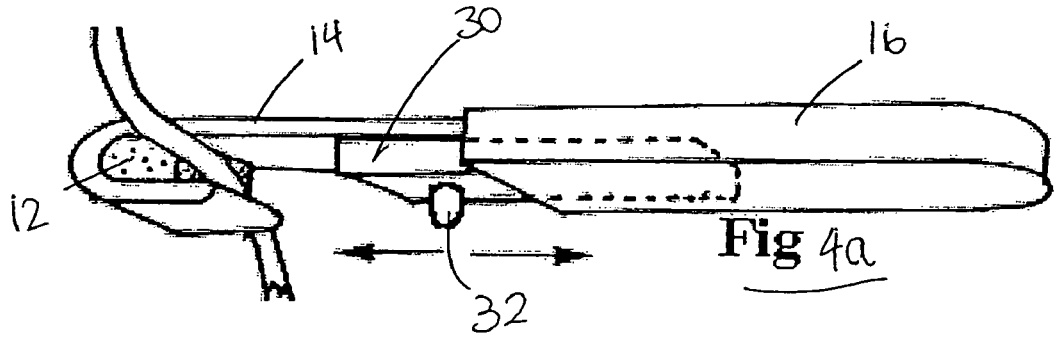
FIG. 4*a* illustrates the basic construction of FIG. 3 and further illustrates a contact member slidingly positionable to urge hair into contact with the hair coloring composition.

The device 10 can be arranged to urge the hair coloring composition 12 into contact with hair. Referring now to FIG. 4*a*, which illustrates a device 10 having the basic construction of FIG. 3, and further including a contact member 30. The contact member 30 is movably supported relative to the grip 16 and is urgingly positionable to an impermanent position in which the hair is pressed into contact with the hair coloring composition. In the arrangement of FIG. 4*a*, the contact member 30 extends from within the handle 16. The hair coloring composition 12 is supported within the hook-like support 14. The contact member 30 may include a projection 32 to enable a user to easily urge the contact member to an extended position (as shown). Any hair disposed within the hook-like support 14 is pressed into contact with the hair coloring composition 12. As a result, relative movement of the device 10 and the hair applies the hair coloring composition to the hair.

Figure 4B:
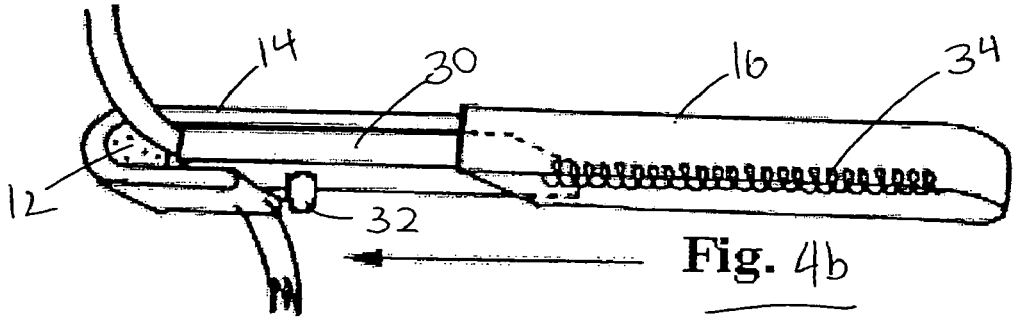
FIG. 4*b* illustrates a variation of the construction of FIG. 4*a* in which the contact member is urged into contact with the hair.
Figure 4C:
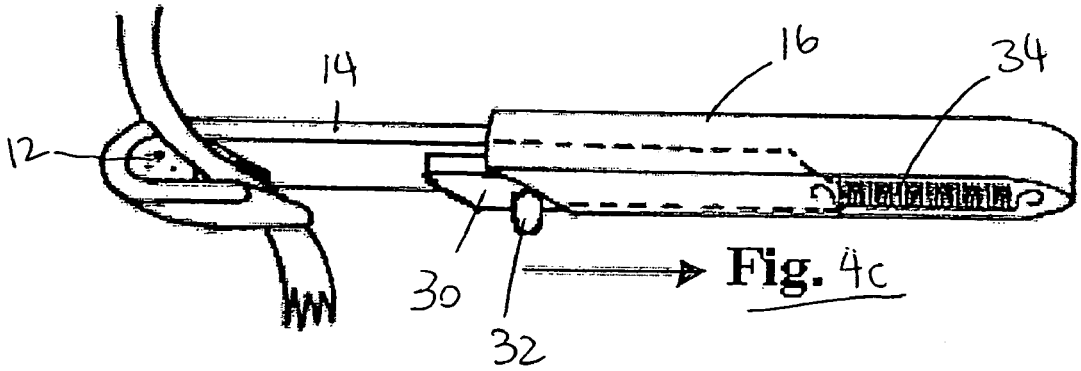
FIG. 4*c* illustrates a variation of the construction of FIG. 4*a* in which the contact member is urged out of contact with the hair.

FIGS. 4*b* and 4*c* also show a bias 34 connected between the contact member 30 and the handle 16 which is preferably included. The bias 34 can be configured to normally bias the contact member into either the extended position, urging the contact member 30 into contact with the hair as shown in FIG. 4*b*, or into a retracted position, urging the contact member 30 out of contact with the hair as shown in FIG. 4*c*. The bias 34 is preferably a spring as shown, but may be any suitable type of bias. The projection 32 is used by the user to manually urge the contact member 30 against the restoring force of the bias.

Figure 5A:
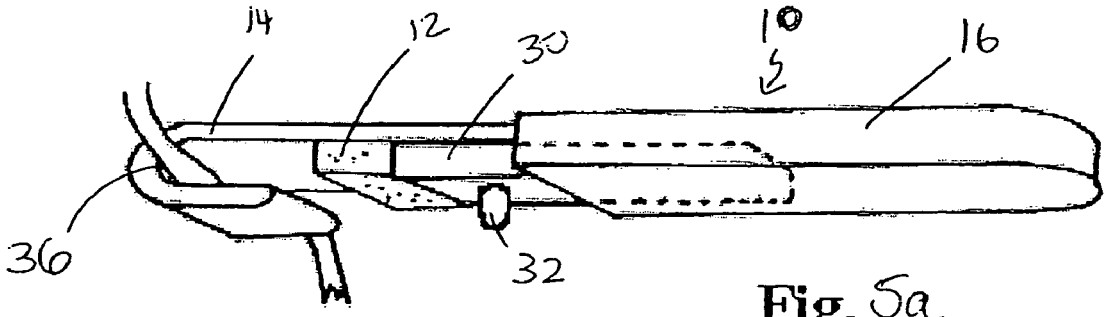
FIG. 5*a* illustrates a variation of the construction of FIG. 3 in which the hair composition is movably mounted on the contact member.
Figure 5B:
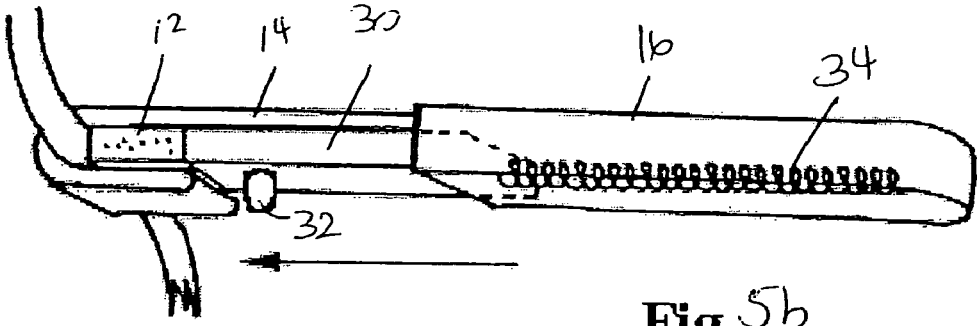
FIG. 5*b* illustrates a variation of the construction of FIG. 5*a* in which the contact member is urged into contact with the bearing surface.
Figure 5C:
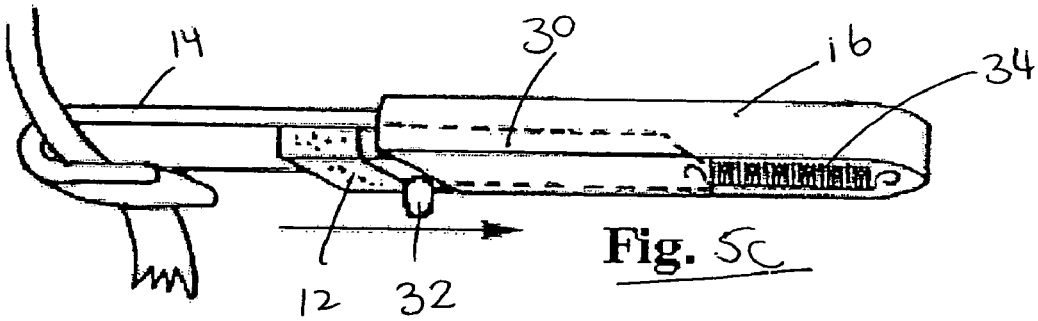
FIG. 5*c* illustrates a variation of the construction of FIG. 5*a* in which the contact member is urged out of contact with the bearing surface.

FIG. 5*a* illustrates a variation of the construction of FIG. 4*a* in which the hair composition 12 is mounted to the contact member 30 and is urgable with the contact member into contact with a bearing surface 36. The bearing surface 36 in the illustrated arrangement is the inside of the hooked end of the support 14. The hair is placed into the hooked end of the support 14, and the hair coloring composition 12 is urged into pressed, direct contact with the hair by the relative movement between the contact member 30 and the bearing surface 36. FIGS. 5*b* and 5*c* also illustrate the bias 34, either biased so as to urge the contact member 30 into the extended position (shown in FIG. 5*b*) or to urge the contact member 30 to the retracted position (shown in FIG. 5*c*), similar to the arrangements of FIGS. 4*b* and 4*c*.

Figure 6:
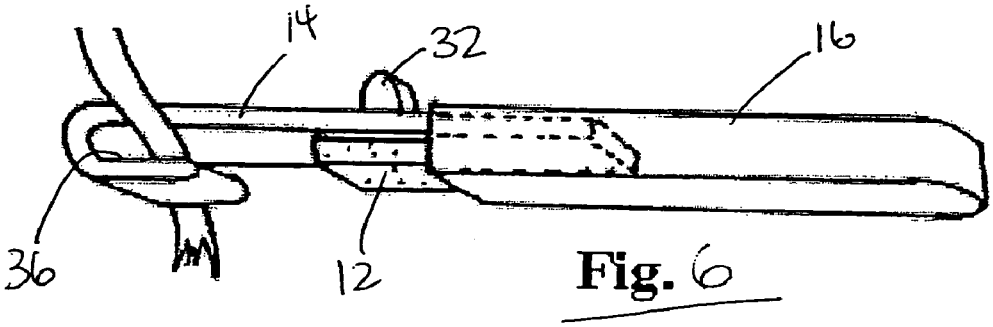
FIG. 6 illustrates a variation of the construction of FIG. 3 and further illustrates a bearing surface is slidingly positionable to urge the hair into contact with the hair coloring composition.

FIG. 6 illustrates a variation of the construction of FIG. 3 in which the hair composition 12 is rigidly mounted relative to the grip 16 on a support surface (not shown in this view). The hook-like support 14, and hence the bearing surface 36 is mounted relative to the grip 16 so that it is slidably movable. The bearing surface 36 is thus slidably moveable into contact with the hair composition 12, such that hair placed in the hooked end of the support 14 can be urged into pressed, direct contact with the hair coloring composition 12.

Figure 7A:
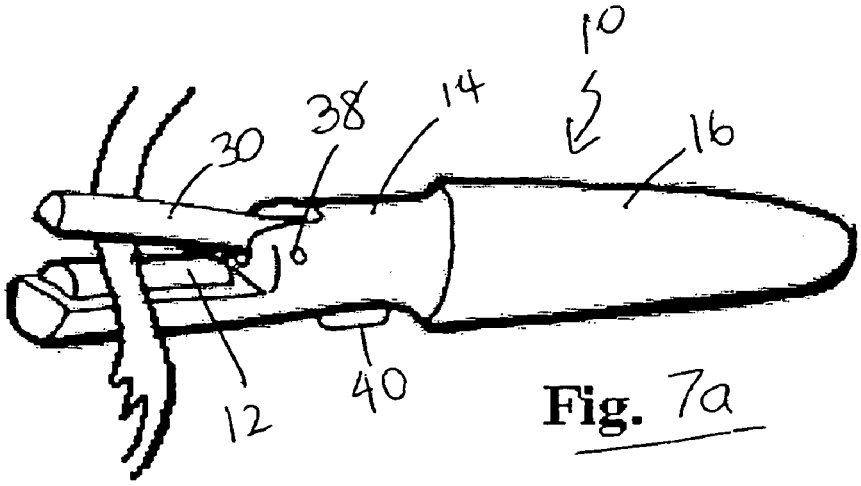
FIG. 7*a* illustrates the basic construction of FIG. 1 and further illustrates the mounting surface included on a moveable arm.
Figure 7B:
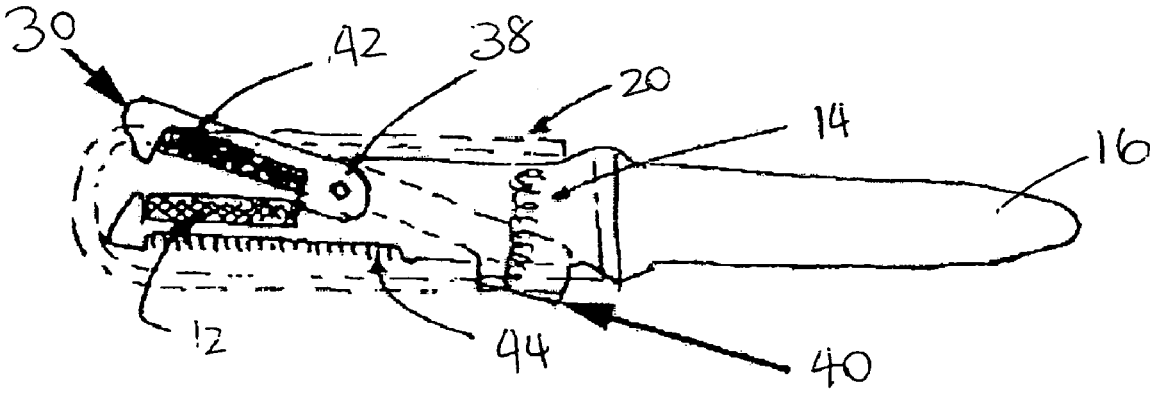
FIG. 7*b* is a part-sectional view of the construction of FIG. 7*a*.

FIGS. 7*a* and 7*b* illustrate a variation of the construction of FIG. 1 in which the contact member 30 is arranged as a movable arm that is pivotally mounted to the device 10 (e.g., to the grip 16 or to the support 14) and positionable to urge hair into contact with the hair coloring composition 12. In the arrangement of FIGS. 7*a* and 7*b*, the hair coloring composition is mounted on support 14. The contact member 30 is pivotally mounted to the support 14 by a pivot pin 38. An end 40 of the contact member 30 may project through an aperture (not shown) in the support 14 to form an actuation button. The user can depress the end 40 of the member 30 to shut the urge the member 30 against the support 14. A foam pad 42 may be provided on the contact member 30 to enable device 10 to slide easily along a strand of hair grasped between the contact member 30 and the support 14. A comb 44 may optionally be provided.

Figure 8A:
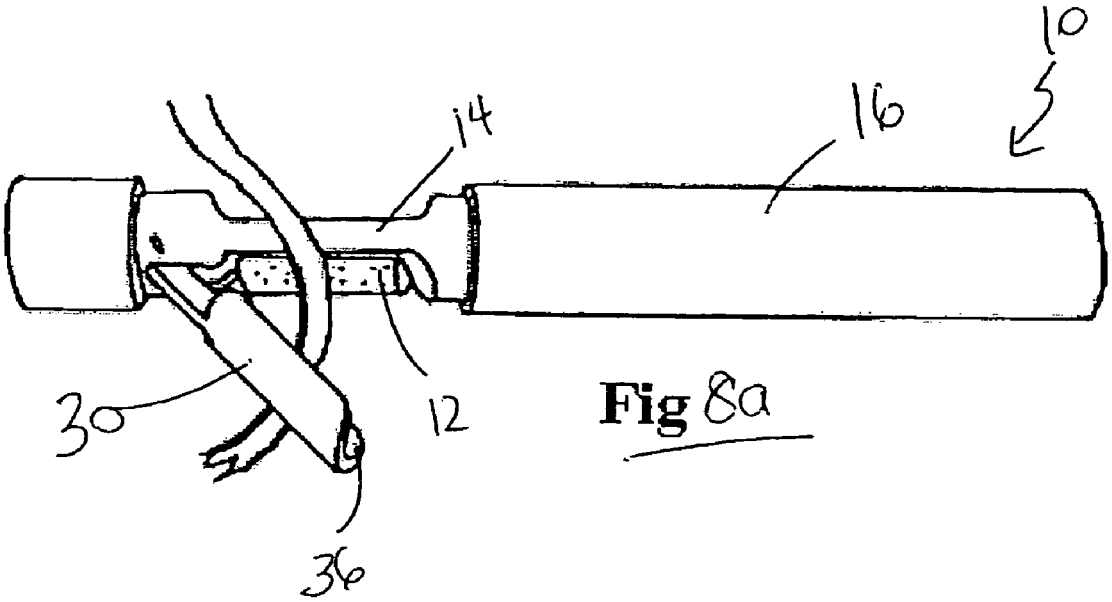
FIG. 8*a* illustrates the basic construction of FIG. 1 and further illustrates a movable arm positionable to urge hair into contact with the hair coloring composition.
Figure 8B:
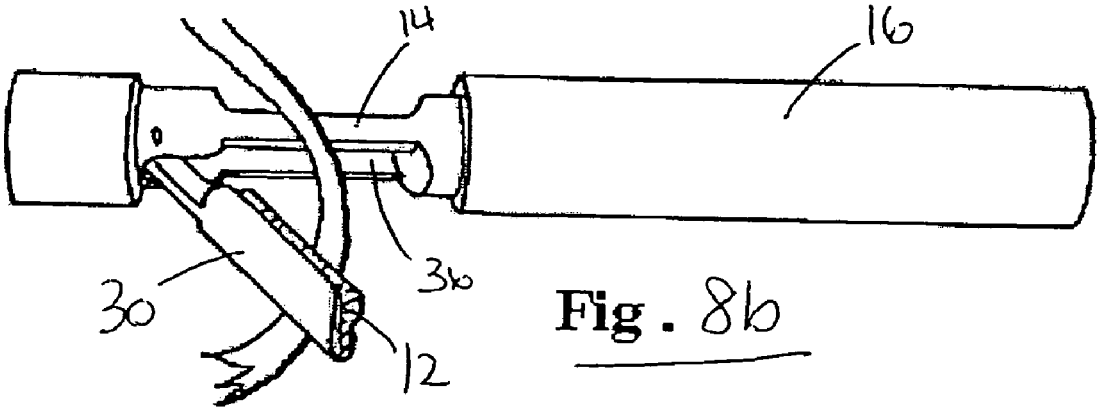
FIG. 8*b* illustrates the basic construction of FIG. 8*a* and further illustrates the hair coloring composition mounted on to the movable arm.
Figure 8C:
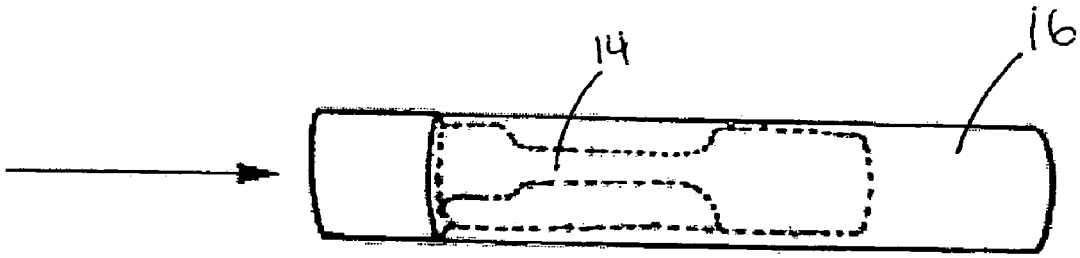
FIG. 8*c* illustrates the basic construction of either FIG. 8*a* or FIG. 8*b*, with the hair coloring composition assembly slid inside the handle for transportation.

FIGS. 8*a*–8*c* illustrate a variation of the construction of FIGS. 7*a* and 7*b*. The contact member 30 may optionally be biased outwardly by a bias (not shown) such as a spring, and the user may close the contact member 30 to retain a strand of hair between the contact member 30 and the support 14. The hair coloring composition 12 can be mounted on the support 14 with the contact member 30 having a bearing surface 36, as shown in FIG. 8*a*. Alternatively, the hair coloring composition 12 can be mounted on the contact member 30 with the support 14 having a bearing surface 36, as shown in FIG. 8*b*. A strand of hair may be placed between the contact member 30 and the support 14, and a user can hold the contact member 30 against the strand of hair while pulling the device 10 along the strand, thus pressing the hair into contact with the coloring composition 12. Optionally, the support 14, hair coloring composition 12 and contact member 30 can be stored in the handle 16 with the contact member 30 adjacent the support 14, as shown in FIG. 8*c*, either by axially collapsing the support into the handle 16, or by separating the support from the handle and inserting the support 14 into the handle 16.

Figure 9A:
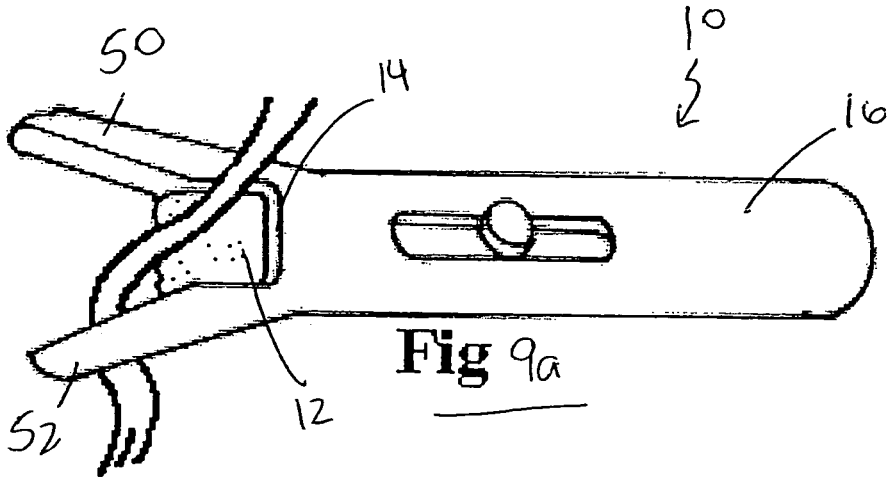
FIG. 9*a* illustrates the basic construction of FIG. 1 and further illustrates two arms for directing hair to the hair coloring composition.
Figure 9B:
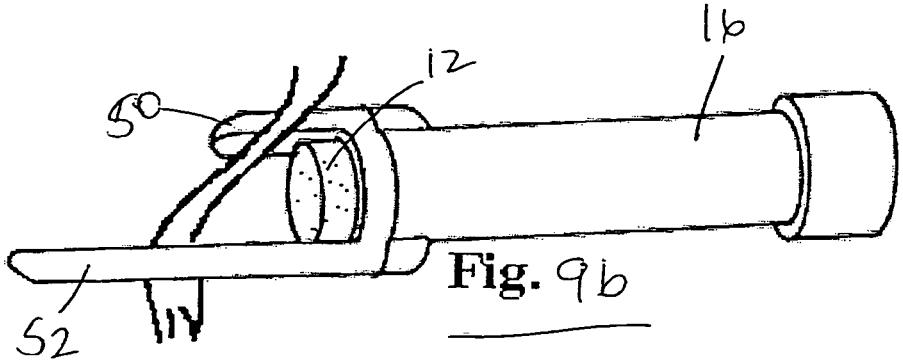
FIG. 9*b* illustrates a variation of the construction of FIG. 9*a* in which one of the arms is longer than the other.

FIGS. 9*a* and 9*b* illustrate another variation of the basic construction of FIG. 1, in which the support 14 is formed into two arms 50, 52. The hair coloring composition 12 is placed between the arms 50, 52, which may be arranged in a V-shape, as shown in FIG. 9*a*, such that hair placed between the two arms 50, 52 is retained against the hair coloring composition 12 as the device 10 is pulled along a hair strand. Alternatively, the arms 50, 52 may be generally straight, but one of the arms may be longer than the other, as illustrated in FIG. 9*b*, to aid in retention of the hair against the hair coloring composition 12.

Figure 10:
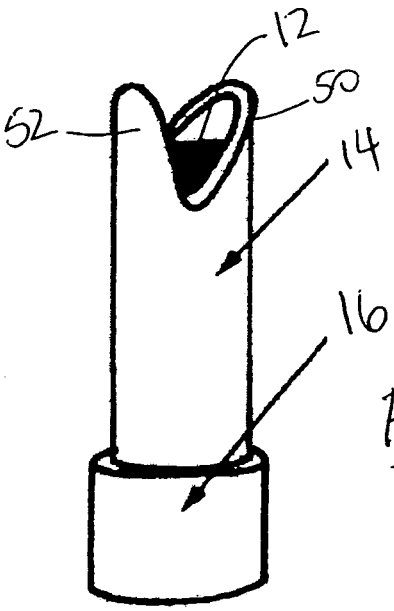
FIG. 10 illustrates the basic construction of FIG. 1 and further illustrates the hair coloring composition being slidably retractable in the handle.

FIG. 10 illustrates a variation of the construction of FIGS. 9*a* and 9*b*, in which the hair coloring composition 12 is retractably mounted within the support 14, and which the arms 50, 52 of the support 14 are formed by a generally V-shaped notch in the support 14. The shape of the device 10 is similar to a standard lipstick, except for the V-shaped notch, which retains the hair against the hair coloring composition 12.

Figure 11:
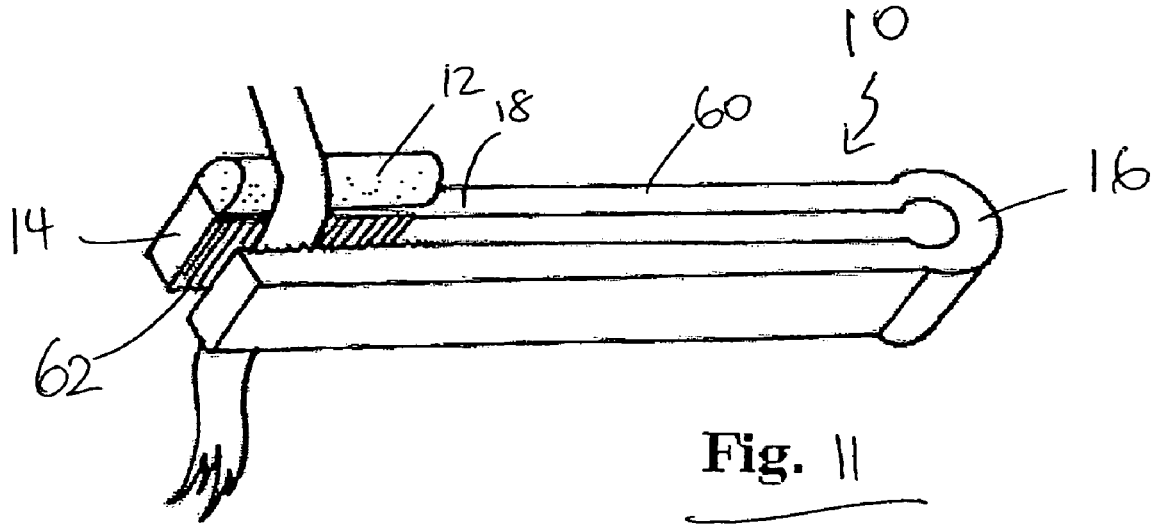
FIG. 11 illustrates the basic construction of FIG. 1 and further illustrates a clamp useful for a one-handed operation of stretching hair from a scalp while urging hair into contact with the hair composition.

FIG. 11 illustrates another arrangement of the basic construction of FIG. 1. In FIG. 11, the device 10 comprises a pincer-like clamp 60 which can be moved from an open hair-receiving position to a closed hair-engaging position. As illustrated, the handle 16 may be formed by one end of the clamp 60, and the support 14 may be formed by the open end of the clamp such that the handle and support are a unitary construction, and can be one and the same element. The support end can include serrations 62 that improve the gripping of a hair strand within the clamp. The hair coloring composition 12 is disposed exteriorly of the clamp 60, on surface 18, which may form a side surface of the clamp 60. In use, hair can be engaged by squeezing the clamp 60 closed over the hair strand. The device 10 is then turned slightly to press the hair against the hair coloring composition 12, while the clamp 60 ensures that the hair remains taut as the device of FIG. 11 is moved along the hair strand.

FIGS. 12*a* and 12*b* illustrate another alternative arrangement of the basic construction of FIG. 1. As can be seen in FIG. 12*a*, the hair coloring composition 12 and the contact member 30 have complementary curved shapes. The hair is forced to take a curved path over the hair coloring composition, with the contact member 30 holding the hair in place, as shown in FIG. 12*b*. With a straight path over the hair coloring composition, the hair can sometimes wear a groove into the coloring composition block. This can mean that the applicator does not function as well as it does when the coloring composition block is intact, because the hair can be pulled relatively easily through the groove without rubbing on the coloring composition. The curved path causes the hair to be rubbed against the hair coloring composition 12 more effectively than with a straight path.

FIGS. 12*c* and 12*d* illustrate a variation of the construction of FIGS. 12*a* and 12*b*, in which a gripping material 70 is added to the contact member. The gripping material may be any suitable foam or rubber-like material which is deformable and capable of gripping hair. The gripping material 70 grips the hair as it passes through the device 10 so that the hair is caused to stretch slightly over the hair coloring material 12. It will be appreciated that the gripping material may also be employed in the embodiments that do not have a curved path for the hair to travel through.

FIGS. 13*a* and 13*b* illustrate further variations of the construction of FIGS. 12*a* and 12*b*, showing alternative curved paths for the hair to take through a hair coloring composition applicator. In the arrangements shown in FIGS. 13*a* and 13*b*, two blocks of hair coloring composition 12 are shown. In FIG. 13*a*, one of the blocks of hair coloring composition 12 is provided on the support 14, whereas a second block of hair coloring composition 12 is provided on the contact member 30. In FIG. 13*b*, two blocks of hair coloring composition 12 are provided on the support 14, and the contact member 30 includes a shaped block 72 which forces the hair to follow the contours of the blocks of hair coloring composition. These arrangements force the hair to take a serpentine path through the hair coloring composition applicator, ensuring that the hair remains in contact with the hair coloring composition 12 for a relatively long period of time, thus increasing the efficiency of transfer of the coloring composition 12 to the hair.

FIGS. 13*c* and 13*d* illustrate a variation of the construction of FIGS. 13*a* and 13*b*, in which a gripping material 70 is added to the contact member or to both the contact member 30 and the support 14. The gripping material 70 may be added to one side of the device 10, for example, on the side that travels along the hair first as the device is pulled along a hair strand.

Figure 14:
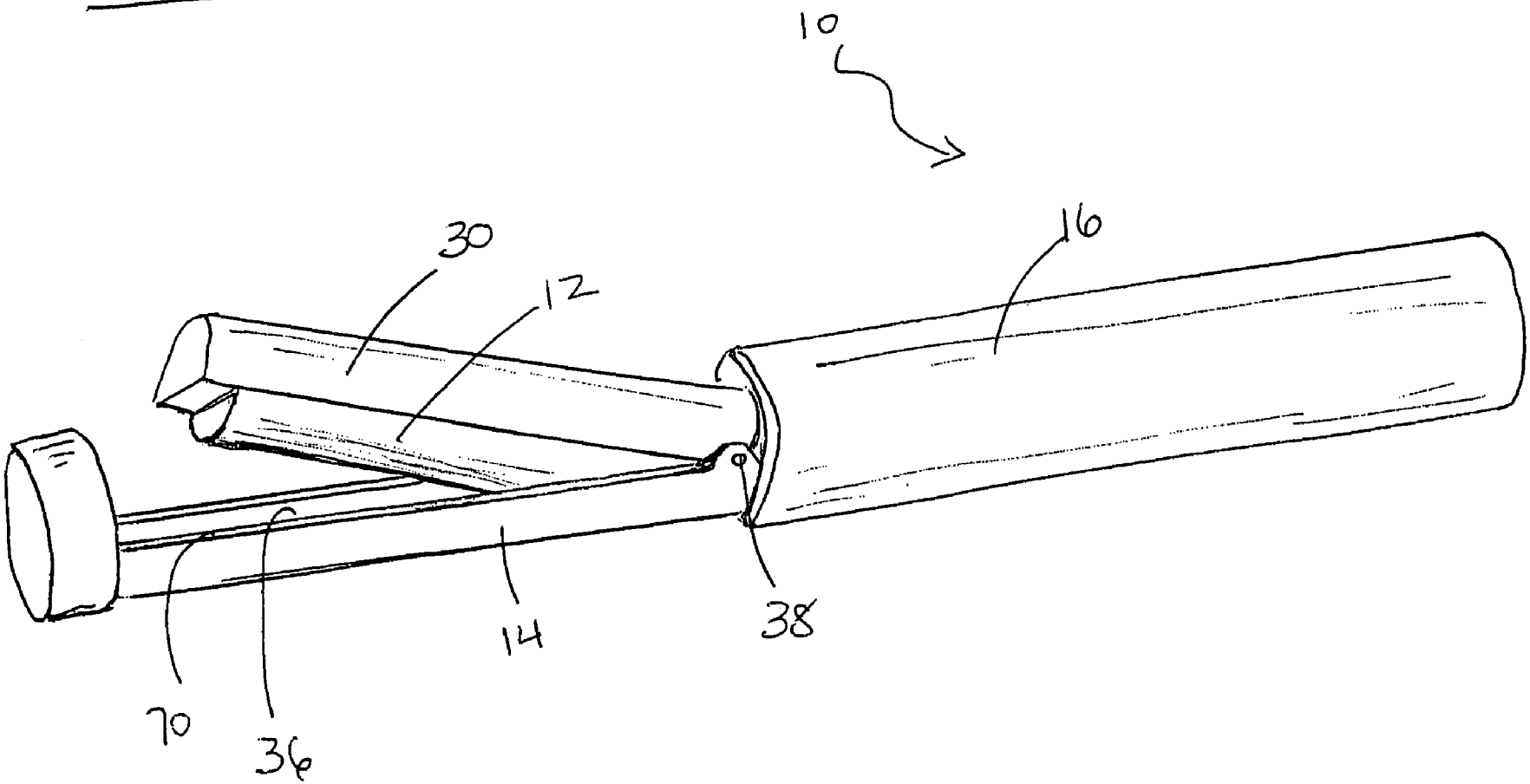
FIG. 14 illustrates the basic construction of FIG. 1 and further illustrates a movable arm positionable to urge hair into contact with the hair coloring composition.

FIG. 14 illustrates a further variation of the basic construction of FIG. 1. The contact member 30 may optionally be biased outwardly by a bias (not shown) such as a spring, and the user may close the contact member 30 to retain a strand of hair between the contact member 30 and the support 14. The contact member 30 may be pivotally connected to the support 14 by means of a pivot pin 38. The pivot pin 38, and hence the pivotal connection of the support 14 and the contact member 30 may be located towards the center of the device 10 such that the contact member 30 opens towards the end of the device 10. The hair coloring composition 12 can be mounted on the contact member 30 with the support 14 having a bearing surface 36, that may include a foam pad forming a gripping material 70. Alternatively, the hair coloring composition 12 can be mounted on the support 14 with the contact member 30 having a bearing surface 36 (not shown). A strand of hair may be placed between the contact member 30 and the support 14, and a user can hold the contact member 30 against the strand of hair while pulling the device 10 along the strand, thus pressing the hair into contact with the coloring composition 12. Optionally, the support 14, hair coloring composition 12 and contact member 30 can be stored in the handle 16 with the contact member 30 adjacent the support 14 by axially collapsing the support into the handle 16.

The hair coloring composition 12 can comprise any suitable solid or semi-solid coloring composition that retains its shape on the support 14 at room temperature and at temperatures ranging up to, say, 105° F.–125° F. Additionally, a solid or semi-solid coloring composition will not drip or slide from a support. The hair coloring composition 12 is glued or otherwise adhered or attached (e.g., when molded) to the mounting surface 18. The hair coloring composition 12 can comprise a permanent hair dye or a nonpermanent (temporary) coloring composition. In the preferred embodiment, hair coloring composition 12 can be easily washed out of the hair. The hair coloring composition 12 can comprise a single color, or can be a combination of two or more colors. Optionally, the composition 12 contains other components such as glitter that are applied to the hair together with the hair coloring composition. The hair coloring composition 12 can also include various scents which are optionally associated with the color of the hair coloring composition 12. For example, a bright pink hair coloring composition may be associated with a strawberry or bubblegum scent.

Optionally, the hair can be pre-treated prior to application of the hair coloring composition 12 to condition the hair and facilitate the transfer of hair coloring composition 12 from the support 14 to the hair. The pretreatment may be water, hair spray, alcohol or any other liquids capable of facilitating the transfer of the hair coloring composition 12 to the hair. A fixative can be used for adhering particles of hair coloring composition 12 to strands of hair until washed out or for a longer period of time.

The hair coloring composition 12 can comprise a liquid-crystal composition which can be made into a wide range of hardnesses. Also, the liquid-crystal technology can be a base for the coloring composition 12.

The base of the coloring compositions is preferably a soap gelling agent. A soap gelling agent, such as sodium stearate, has a structure wherein one end of the molecule is hydrophilic and the other end is oliophilic. As such, when the soap gelling agent is dissolved in water and a miscible solvent, the soap gelling agent molecule is capable of orienting one end in each solvent. Due to the optimum packing order of, for example, the sodium stearate molecules, tubes may be formed. These tubes can partition the water and the co-solvent. See U.S. Pat. No. 5,585,092 for Gel Deodorant Compositions and U.S. application Ser. No. 10/877,611, filed Jun. 25, 2004, for Color Compositions and Methods of Using Same, the entire contents of which are both hereby incorporated by reference. The soap gelling agents hereof can be salts of fatty acid containing from about 12 to about 40 carbon atoms ($C_{12}$–$C_{40}$), preferably salts of $C_{12}$–$C_{22}$ fatty acids, more preferably $C_{14}$–$C_{20}$, and most preferably $C_{16}$–$C_{20}$. Suitable salt forming cations for use in these gelling agents include metal salts such as alkali metals, e.g. sodium and potassium, alkaline earth metals, e.g., magnesium, and aluminum. Preferred are sodium and potassium salts.

Examples of fatty acids useful in synthesizing the gel forming agents herein include myristic, palmitic, stearic, oleic, linoleic, linolenic, margaric and mixtures of such acids. Naturally occurring sources of such fatty acids include coconut oil, beef tallow, lanolin, fish oil, beeswax, palm oil, peanut oil, olive oil, cottonseed oil, soybean oil, corn oil, rapeseed oil, rosin acids, and greases.

Preferred fatty acid soap type gel forming agents include sodium stearate, sodium palmitate, potassium stearate, potassium palmitate, sodium myristate, and aluminum monostearate. The most preferred gel forming agent is sodium stearate. Mixtures of soap gelling agents can also be used.

While the present embodiments contemplate the use of soap gelling agents (including sodium stearate), liquid-crystal forming polymers can also be used in the coloring composition. Any polymer employed in the present invention preferably should be capable of forming a liquid-crystal.

In addition to the soap gelling agent and water, the coloring compositions can use a co-solvent. The co-solvent can be any co-solvent capable of forming a coloring composition with the soap gelling agent (e.g., sodium stearate) and water. Thus, the co-solvent can be a glycol, for example, propylene glycol. Other glycols or polyhydric alcohols can also be used, such as dipropylene glycol, ethylene glycol, diehylene glycol, butylene glycol, hexylene glycol, glycerol, glycerin, or any glycol mentioned in U.S. Pat. No. 6,299,891, which is hereby incorporated by reference. When sodium stearate is dissolved in water and propylene glycol, a liquid crystal forms, with the oliophilic end of the sodium stearate oriented toward the propylene glycol, and water oriented at the hydrophilic end of the sodium stearate. As the material cools, the crystals form, with the length of the crystal being determined by the rate of cooling. The faster the cooling rate, the shorter the crystal and the shorter the cooling rate, the longer the crystal.

The soap gelling agent will typically form crystals. The length of the crystal has an effect on the mechanical properties of the resulting composition. Longer crystals are generally more flexible and, as a result, are generally weaker than shorter crystals. As such, shorter crystals are comparably stronger. For example, a composition having a mixture of 33% short crystals and 66% liquid may be as strong as a composition that is 100% hard wax.

The overall physical properties of hair coloring compositions that include these preferred materials is determined by the ratio of the liquid-crystal forming polymer, water, and co-solvent. If sodium stearate is selected to be the soap gelling agent, then the ratio of the water to co-solvent to sodium stearate determines the concentration of the crystals and the continuous phase.

Preferably, the water and glycol are present in substantially equal amounts, whereas the soap gelling agent is present in a lesser amount. Thus, the amount of soap gelling agent (e.g., sodium stearate) in the coloring composition can be from about 15 to about 50% less than the amount of the water and the co-solvent. As such, the hair coloring composition includes from about 20 to about 35% by weight of the total coloring composition of water and the co-solvent, and from about 10 to about 30% by weight of sodium stearate. More preferably, the hair coloring composition includes from about 26 to about 32% by weight of the total coloring composition of water and the co-solvent, and from about 12 to about 15% by weight of sodium stearate.

The base coloring composition optionally includes a component to improve the spreadability of the coloring composition, thereby making the composition easier to apply to the hair. For example, this component can be a silicone polymer. One example of a silicone polymer that may be used is Gafquat H—Si, which is manufactured by International Specialty Products (ISP, Wayne, N.J.), though other sources for functionally equivalent silicone polymers exist. The amount of the silicone polymer added can range from about 1% to about 5% by weight of the total coloring composition. A preferred amount of silicone polymer is about 2% by weight of the total coloring composition.

A coloring agent is added to the base. One of the problems with conventional coloring agents is that not all colors appear the same when applied to substrates having different colors. For example, a blue color applied to blonde hair may appear different than the same blue color applied to black hair as the "blueness" is much less noticeable on the darker substrate. It is preferred that the coloring agent in the color composition 12 result in a coloring composition that appears substantially the same, regardless of the color of the substrate to which it is applied.

Accordingly, the coloring agent preferably includes titanium dioxide and a colorant. The titanium dioxide is used to effectively "hide" or cover up the color of the underlying substrate such that the color of the colorant may be seen regardless of the color of the underlying substrate. As such, the coloring composition 12 can be applied to all types and colors of hair. The amount of titanium dioxide can range from about 5 to about 20% by weight of the total coloring composition. More preferably, the amount of titanium dioxide is from about 7 to about 15% by weight of the total coloring composition. Other materials besides titanium dioxide can be used including, but not limited to, barium sulfate, aluminum silicates, calcium carbonates, and combinations thereof or, more generally, appropriate metal salts that permit the colorants in the composition to show true when applied to hair of varying color.

When titanium dioxide or a related material is used as part of the coloring agent, the coloring agent includes a colorant. The colorant is the component that actually provides the color that is seen. The amount of colorant to be used will vary depending on the amount of titanium dioxide, the color of the colorant, and/or the selected degree of color for the finished coloring composition. Illustratively, the total amount of titanium dioxide and colorant is from about 15 to about 30% by weight of the total coloring composition. More preferably, the total amount of titanium dioxide and colorant is from about 20 to about 25% by weight of the total coloring composition. Accordingly, the amount of colorant can be from about 5 to about 20% by weight of the total coloring composition, and more preferably from about 7 to about 15% by weight of the total coloring composition. Examples of colorants useful in the present invention include, but are not limited to, Sandsperse Blue WF253, Napthol Red 2R Dispersion, and Optiflow Yellow 74. Other colorants that can be used include those listed by the Food and Drug Administration under Color Additives Approved for Use in Cosmetics (Part 73, Subpart C and Part 74, Subpart C) as currently listed and/or as amended in the future. This publication is hereby incorporated by reference.

Optionally, the coloring composition can include a metallic coloring agent to produce a metallic color. When a metallic coloring agent is used, no titanium dioxide is required. One metallic coloring agent is a mica-based metallic. As no titanium dioxide is necessary, additional amounts of the metallic coloring agent can be used in the final coloring composition. Accordingly, the amount of the metallic coloring agent can range from about 15 to about 25% by weight of the total coloring composition, and more preferably is about 20% by weight of the total coloring composition. Examples of metallic coloring agents useful in the present invention include, but are not limited to, DynaColor 98392B15A BlueGreen, Allair Type 303 Gold, and DynaColor RB639XV19A available from Dynacolor Inc. Other metallic coloring agents that can be used include those metallic coloring agents listed by the Food and Drug Administration under Color Additives Approved for Use in Cosmetics (Part 73, Subpart C and Part 74, Subpart C) as currently listed and/or as amended in the future.

In addition to the base and the coloring agent, the coloring compositions of the present can include other optional components for a variety of purposes. For example, a dispersant for preventing agglomeration between the pigment particles in the coloring composition. One example of a dispersant that can be used in the present invention is Tamol 731, a sodium salt of a carboxylated polyelectrolyte available from Rohm & Haas (Philadelphia, Pa.). The dispersant can be added in an amount of from about 0 to about 5% by weight of the total coloring composition. Other dispersants can be used, including those manufactured by, e.g., Olin, Rohm & Haas, Stefan. Examples of dispersants include, without limitation, soluble salts of low molecular weight homopolymers or copolymers of polyacrylic acids, partially hydrolyzed polyacrylamides, maleic anhydride copolymers, and polyaspartic acid.

The coloring composition also can include a bactericide to prevent growth of bacteria in the product prior to use. One example of a suitable bactericide is Germall®, a member of the substituted imidazolidinyl urea family of compounds available from ISP. The bactericide may be added in an amount of from about 0 to about 1% by weight of the total coloring composition. Other commercially available bactericides, such as quaternary ammonium compounds may be used. In addition, other bactericides and fungicides may also be used.

The coloring composition can include a defoaming agent to help control foaming during production of the compositions of the present invention. One example of a suitable defoaming agent is Foamstar™ A-12, a polymer available from Cognis (Cincinnati, Ohio). The defoaming agent can be added in an amount of from about 0 to about 3% by weight of the total coloring composition.

The coloring composition 12 can be made by mixing the water and co-solvent together, then heating to a temperature above which the soap gelling agent melts, generally above about 60° C., to form the base. Then, the coloring agent and any optional compounds as noted above can be added and the mixture heated to a temperature of from about 90 to about 100° C. to thoroughly mix all of the components. Then, the mixture is preferably cooled gradually to form the liquid crystals and the coloring compositions. The rate of cooling is preferably controlled to control the final strength of the coloring composition, wherein a faster rate of cooling results in a softer composition and a slower rate of cooling results in a firmer composition. The coloring composition can then be molded into a prescribed shape for attaching to the support 14.

The device can be used for a variety of purposes. For instance, and not by way of limitation, the hair coloring device can be used to add streaks of bright colors to hair for a fun effect. The device can also be used to color a natural streak of hair on a person that is not the same color as the rest of the hair. For example, the device can be used to add color to a streak of gray hair so that the gray streak blends in with the surrounding hair. In another example, the hair coloring device can be used to apply a highlight, such as a blonde streak, to a head of hair. In yet another example, the device can be used to add streaks of multiple colors to a head of hair.

The foregoing is provided for purposes of illustrating, explaining, and describing embodiments of this invention. Modifications and adaptations to these embodiments will be apparent to those skilled in the art and may be made without departing from the scope or spirit of this invention. All publications and patents mentioned herein are incorporated by reference in their entirety, including all figures, graphs, equations, illustrations, and drawings to describe and disclose specific information for which the reference was cited.

The invention claimed is:

1. A hair coloring device, comprising:

a support;

a solid or semi-solid hair coloring composition fixedly disposed on the support, the solid or semi-solid hair coloring composition comprising a soap gelling agent such that the hair coloring composition retains its shape.

2. The hair coloring device according to claim 1, wherein the hair coloring composition is provided as a block having a predefined shape.

3. The hair coloring device according to claim 2, wherein the hair coloring composition block is disposed on a first surface of the support.

4. The hair coloring device according to claim 2, wherein the predefined shape of the hair coloring composition block includes a concave or a convex surface facing away from the support.

5. The hair coloring device according to claim 1, further comprising a movable contact member which is urgingly positionable by a user to place hair into contact with the hair coloring composition.

6. The hair coloring device according to claim 5, further comprising a gripping material disposed on at least one of the movable contact member and the support member, the gripping material aiding retention of hair on the hair coloring material.

7. The hair coloring device according to claim 5, further comprising a bias acting upon the movable contact member, the bias urging the cover toward or away from the hair.

8. The hair coloring device according to claim 7, wherein the bias is connected between the contact member and the support.

9. The hair coloring device according to claim 5, wherein the contact member comprises a pivotally mounted clamp.

10. The hair coloring device according to claim 1, wherein a curved path for hair is defined against the hair coloring composition.

11. The hair coloring device according to claim 10, wherein the curved path is defined between a movable contact member and the hair coloring composition.

12. The hair coloring device according to claim 10, wherein at least two hair coloring composition blocks are provided, and wherein the curved path is defined such that the hair contacts said at least two hair coloring composition blocks.

13. The hair coloring device according to claim 10, wherein the curved path is a serpentine path.

14. The hair coloring device according to claim 1, wherein the hair coloring composition is formed of water, a co-solvent, a soap gelling agent, a coloring agent, and a silicone polymer.

15. The hair coloring device according to claim 14, wherein the soap gelling agent is sodium stearate.

16. The hair coloring device according to claim 14, wherein the hair coloring composition is formed of from about 20 to about 35% by weight of water, from about 20 to about 35% by weight of co-solvent, from about 10 to about 30% by weight of soap gelling agent, and from about 15 to about 30% by weight of coloring agent.

17. The hair coloring device according to claim 16, wherein the composition further includes from about 1 to about 5% by weight of a silicone polymer.

18. The hair coloring device according to claim 14, wherein the hair coloring composition is formed of from about 27 to about 32% by weight of water, from about 26 to about 31% by weight of the co-solvent, and from about 12 to about 15% by weight of sodium stearate as the soap gelling agent.

19. The hair coloring device according to claim 14, wherein the hair coloring composition includes from about 20 to about 25% by weight of the coloring agent.

20. The hair coloring device according to claim 14, further comprising at least one additional component selected from the group consisting of: a dispersant, bactericide, fungicide, defoaming agent, and a combination thereof.

21. The hair coloring device according to claim 20, wherein the co-solvent is propylene glycol.

22. The hair coloring device according to claim 14, wherein the coloring agent includes titanium dioxide and a colorant.

23. The hair coloring device according to claim 22, wherein the coloring agent includes from about 5 to about 20% of titanium dioxide and about 5 to about 20% of the colorant.

24. The hair coloring device according to claim 22, wherein the coloring agent includes from about 8 to about 15% of titanium dioxide and about 7 to about 15% of the colorant.

25. The hair coloring device according to claim 14, wherein the coloring agent includes from about 15 to about 30% of a metallic coloring agent.

26. The hair coloring device according to claim 25, wherein the coloring agent includes about 20% of the metallic coloring agent.

* * * * *